United States Patent [19]

Steinbach

[11] 4,326,396

[45] Apr. 27, 1982

[54] PLATE TUMBLER FOR A CYLINDER LOCK MECHANISM

[75] Inventor: Robert L. Steinbach, Glendale Heights, Ill.

[73] Assignee: Chicago Lock Co., Chicago, Ill.

[21] Appl. No.: 111,536

[22] Filed: Jan. 14, 1980

[51] Int. Cl.[3] ..... E05B 15/14; E05B 29/02

[52] U.S. Cl. ..... 70/364 R; 70/377

[58] Field of Search ..... 70/364 R, 376, 377, 70/392, 416, 419

[56] References Cited

U.S. PATENT DOCUMENTS

| | | | |
|---|---|---|---|
| 1,406,573 | 2/1922 | Mantanfel . | |
| 1,406,574 | 2/1922 | Mantanfel . | |
| 1,489,338 | 4/1924 | Baird . | |
| 1,964,963 | 7/1934 | Shinn . | |
| 2,047,966 | 7/1936 | Jacobi | 70/377 |

*Primary Examiner*—Robert L. Wolfe

*Attorney, Agent, or Firm*—Gerlach, O'Brien & Kleinke

[57] ABSTRACT

A plate tumbler for a cylinder lock mechanism, such mechanism including a tubular barrel provided with an internal longitudinal groove, and a key plug assembly rotatable in the barrel, such assembly including a key plug, a plurality of plate tumblers transversely reciprocally movable in slots in the plug and each having an end received in the barrel groove in a locking disposition of the mechanism, and spring means biasing such tumbler ends into the groove, such tumbler being relieved along the side edges of a body portion thereof, as compared to conventional tumblers, at diagonally opposite corners of the body portion, to provide a trailing edge having an arcuate end portion received in the barrel groove in the locking disposition of the mechanism and an adjacent oblique portion at one of the corners, and a leading edge having an oblique end portion at the diagonally opposite corner, whereby the arcuate end portion of the trailing edge hooks over the key plug while the oblique end portion of the leading edge engages the adjacent wall of the tumbler slot when picking torque is applied and the tumbler is manipulated, thereby to prevent the tumbler from being moved into a plug-release position within the plug in a picking operation.

9 Claims, 6 Drawing Figures

PLATE TUMBLER FOR A CYLINDER LOCK MECHANISM

BACKGROUND OF THE INVENTION

This invention relates to plate tumblers for cylinder lock mechanisms. More particularly, the invention relates to an improved plate tumbler and to a cylinder lock mechanism incorporating the tumbler.

Plate tumbler-type cylinder lock mechanisms are susceptible to picking by an operation which involves applying to a plug assembly in the lock mechanism a torque tending to rotate the plug assembly relative to a surrounding barrel, in the direction of an unlocking position of the plug assembly, while operating on tumblers in the plug assembly with a picking tool to place them in release positions. The tumblers project from the plug of the assembly into interlocking engagement with the barrel, and the tool, which may embody a wire or the like, is inserted in a keyway in the plug and into engagement with the tumblers. The tumblers are acted upon by the tool so as to withdraw them from the interlocking engagement and lodge them within the barrel, against an inner surface thereof, as the plug turns slightly under the torque force. Picking of the lock is complete when all of the tumblers are lodged within the barrel, and the plug assembly then is free to rotate to its unlocking position.

OBJECTS OF THE INVENTION

An important object of the invention is to provide a new and improved plate tumbler for a cylinder lock mechanism, which imparts greater pick-resistance to the mechanism.

A particular object is to provide a plate tumbler for a cylinder lock mechanism which will be locked to the plug thereof against transverse movement in the plug when it is attempted to pick the mechanism by applying torque to the assembly of plug and tumblers while operating a picking tool to shift the tumblers so as to catch them in release positions within the barrel of the mechanism.

A more particular object is to provide a plate tumbler having a hook-like end portion, a recessed adjacent portion, and a recessed end portion diagonally opposed to the hook-like portion, which portions cooperate to provide a tumbler accomplishing the foregoing objects.

Another object is to provide a plate tumbler which may be constructed with relatively close width tolerances while yet providing for a rocking movement of the tumbler in the plug under picking torque, which movement is sufficient for positively locking the tumbler to the plug and forestalling movement of the tumbler into a release position.

An accompanying object is to provide such a tumbler which, although subject to rocking movement in the plug, remains accessible to a key inserted through the keyway of the lock mechanism.

An additional object is to provide a plate tumbler which accomplishes the foregoing objects while being relatively strong and resistant to abuse.

A further object is to provide a cylinder lock mechanism incorporating a plate tumbler which accomplishes the foregoing objects and which cooperates and combines with other parts of the mechanism, to provide an improved pick-resistant mechanism.

A still further object is to provide a plate tumbler which accomplishes the foregoing objects and which may be manufactured relatively simply and economically, while cooperating and combining with conventional parts in the lock mechanism.

These and other objects, advantages, and functions of the plate tumbler and the cylinder lock mechanism of the invention will be apparent upon reference to the specification taken in conjunction with the accompanying drawings.

SUMMARY OF THE INVENTION

The improved plate tumbler of the invention is employed in a cylinder lock mechanism which includes a tubular barrel provided with an internal longitudinal tumbler-receiving groove bounded by a tumbler-engaging longitudinal side wall, and a key plug assembly mounted in the barrel for rotation relative thereto from a locking position to an unlocking position, the plug assembly including a key plug, a plurality of plate tumblers disposed in the plug in a longitudinal series, and spring means resiliently mounting the tumblers in the plug. The plug is provided with a longitudinal keyway and with a plurality of transverse tumbler-receiving slots intersecting the keyway and arranged for registry with the groove in the locking position of the plug assembly, each slot being bounded by a pair of opposed tumbler-engaging transverse side walls. Each of the tumblers is received in a tumbler-receiving slot substantially completely within the plug in a plug-release position of the tumbler, and is reciprocally movable in the slot between the release position and a plug-locking position of the tumbler wherein a barrel-engaging end thereof projects from the plug for reception in the groove when in registry with the slot. The tumblers are biased by the spring means towards their locking positions, and they engage a bitted key inserted in the keyway, thereby to move the tumblers out of their locking positions and into their release positions and enable the plug assembly to be rotated to its unlocking position.

The improved tumbler is receivable in a tumbler-receiving slot for movement between such release and locking positions while biased towards its locking position by the spring means and for such engagement with a key, and it includes a plate-like body portion having a leading edge and a trailing edge on opposite sides of a longitudinal axis of the body portion, such body portion being received in one of the slots with the axis extending transversely of the plug and the edges disposed adjacent to respective ones of the transverse side walls bounding the slot for engagement therewith when the tumbler is disposed in the slot, one end portion of the leading edge at a barrel-engaging end of the tumbler projecting from the plug into the groove in the barrel for engagement with the longitudinal side wall to prevent relative rotation of the plug assembly towards its unlocking position when the plug assembly is in its locking position with the tumbler disposed in its locking position in the one slot, the opposite end of the leading edge at the opposite end of the tumbler extending obliquely inwardly in a direction towards the axis and towards the opposite end of the tumbler, one end portion of the trailing edge at the barrel-engaging end of the tumbler projecting from the plug into the groove when the plug assembly is in its locking position with the tumbler disposed in its locking position in the one slot, such one end portion of the trailing edge extending arcuately outwardly from the axis and towards the barrel-engaging end of the tumbler, and a portion of the trailing edge adjacent to such one end portion thereof extending from the latter portion obliquely outwardly in a direction away from the axis and towards the opposite end of the tumbler, whereby, when the plug assembly is in its locking position with the tumbler in its locking position in the said one slot, and torque is applied to the plug assembly tending to rotate it to its unlocking position while a force is applied to the tumbler tending to move the tumbler to its release position in a picking operation, the said one end portion of the leading edge engages the longitudinal side wall, and the opposite end portion of the leading edge engages the adjacent transverse side wall, while the said one end portion of the trailing edge projects laterally outwardly over the plug from the transverse side wall which is adjacent to such end portion, in engagement with the plug to prevent the tumbler from being moved into its release position, thereby to prevent rotation of the plug assembly to its unlocking position.

BRIEF DESCRIPTION OF THE DRAWINGS

In the drawings, like parts are identified by like reference symbols in each of the views, and.

DESCRIPTION OF THE PREFERRED EMBODIMENTS

Figure 1:
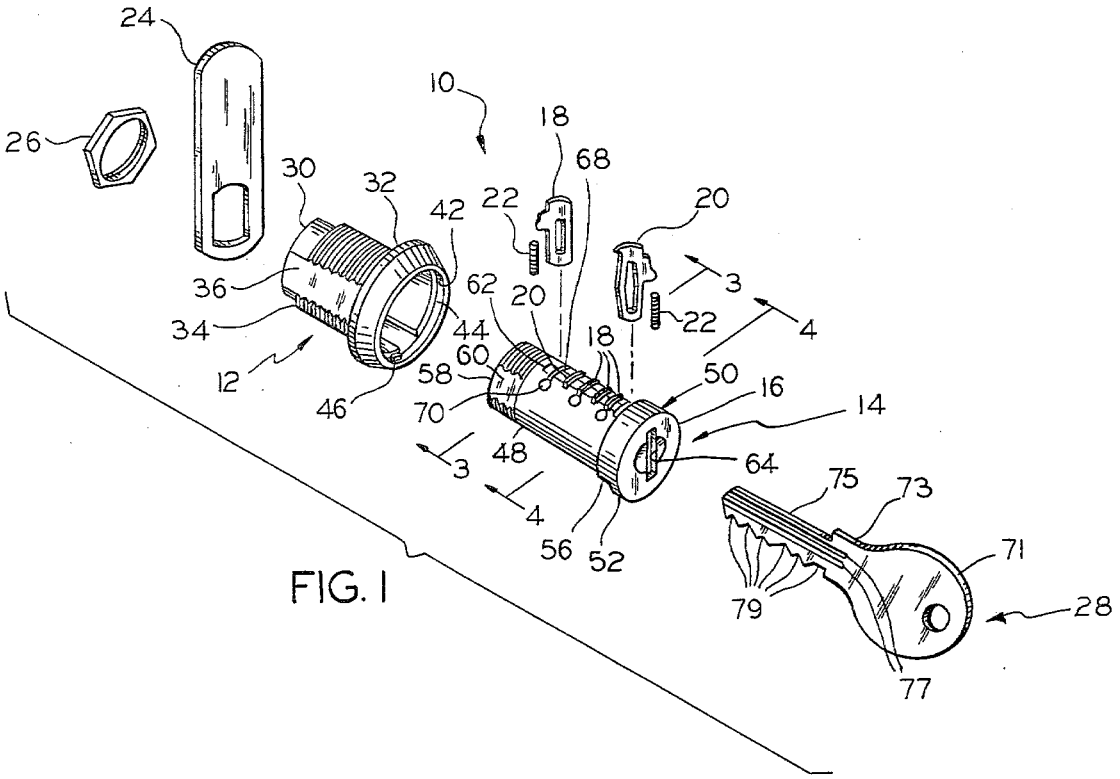
FIG. 1 is an exploded perspective view of a preferred embodiment of the cylinder lock mechanism of the invention, shown with its key, the view including perspective views of a conventional or standard plate tumbler and a preferred embodiment of the new and improved plate tumbler of the invention, respectively.

Referring to the drawings, in particular, to FIG. 1, a plate or disc tumbler-type cylinder lock mechanism 10 includes a tubular barrel 12 and a key plug assembly 14 mounted in the barrel for rotation relative thereto from a locking position to an unlocking position. The plug assembly 14 includes a key plug 16, a set of six conventional and new plate tumblers 18 and 20, respectively, disposed in the plug in a longitudinal series, and coil compression tumbler springs 22 corresponding in number to the tumblers and serving to resiliently mount the tumblers in the plug. In the illustrative application of the lock mechanism 10, a lock plate or cam 24 is mounted on the plug 16 for rotation therewith, and the lock plate is secured on the plug by means of an internally threaded nut 26. The lock is operated by a single-bitted key 28.

The barrel 12 is a conventional part of the lock mechanism, and it includes a generally cylindrical tubular body 30 and an enlarged integral frusto-conical head 32. A mounting screw thread 34 is provided on the outer surface of the body 30, and is interrupted by a pair of opposed mounting flats 36. Such structure serves for mounting the mechanism on a support member having an oblong opening which receives the body 30, with the mechanism secured thereto by means of a nut engaging the thread 34, such arrangement being common and therefore not illustrated.

Referring to FIGS. 1 and 3–6, the barrel 12 has a smooth cylindrical bore 37, which is interrupted by a pair of diametrically opposed internal longitudinal tumbler-receiving locking and clearance grooves 38 and 40, respectively, extending outwardly from the bore. The grooves 38 and 40 are bounded by pairs of opposed, substantially parallel tumbler-engaging longitudinal side walls **38*a*, 38*b* and 40*a*, 40*b*, respectively. As seen in FIG. 1, the head 32 is provided with a counterbore 42, leaving a shoulder 44 at the front end of the bore 37. A stop lug 46 is integral with the wall of the counterbore 42 and with the shoulder 44**.

The key plug 16 is a conventional part of the lock mechanism, and it includes a generally cylindrical body 48 and an enlarged integral circular head 50 at the front end of the body. The head 50 includes an annular rim 52 and an integral arcuate stop member 56, which projects rearwardly from the rim. A rear portion 58 of the body 48 is externally threaded, and the threads are interrupted by flats 60, for mounting the lock plate 24 thereon and securing the plate by means of the nut 26 in threaded engagement with the rear portion.

A generally rectangular longitudinal slot 62 extends axially through the body 48. A longitudinal keyway 64 extends through the plug, in registry with the slot 62, which forms a part of the keyway. Key guide lugs or wards 66 are formed integrally in the plug 16 into the keyway 64. Six generally rectangular tumbler-receiving transverse slots 68 extend through the plug body 48, in spaced parallel relation to each other in a longitudinal series and intersecting the longitudinal slot 62 and thus also the keyway 64. Each of the transverse slots 68 is bounded by two substantially parallel opposed tumbler-engaging transverse side walls **68*a* and 68*b* (FIG. 6), which walls are in like dispositions for alternate slots 68 and transposed for adjacent slots 68, such transposition being illustrated in FIGS. 3 and 4. A slightly rounded edge or radius 68*c* is formed on the plug 16 in manufacturing at each end of each of the transverse side walls 68*a* and 68*b***.

Transverse cylindrical spring-receiving blind bores 70 are formed in the plug body 46, one of the bores being provided adjacent to and in communication with each of the transverse slots 68 along one side edge of the slot. Each blind bore 70 intersects a slot 68, to form a generally rectangular transverse communicating opening **70*a* (see FIG. 6) therebetween and adjacent to a transverse side wall 68*a*. Alternate bores 70 and their adjacent transverse side walls 68*a* are disposed on opposite sides of the keyway 64**.

The key 28 is a conventional flat key, including a flat bow 71, an integral shank 73 extending therefrom, and a bit 75 extending from the shank. Guide grooves 77 are provided on opposite sides of the bit 75, and they are complementary to respective ones of the guide lugs 66.

The key has six bittings 79, corresponding to the number of tumblers 18 and 20.

Figure 3:
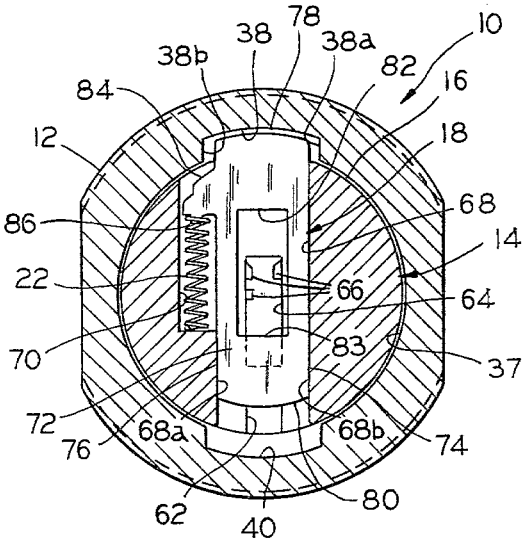
Figure 2:
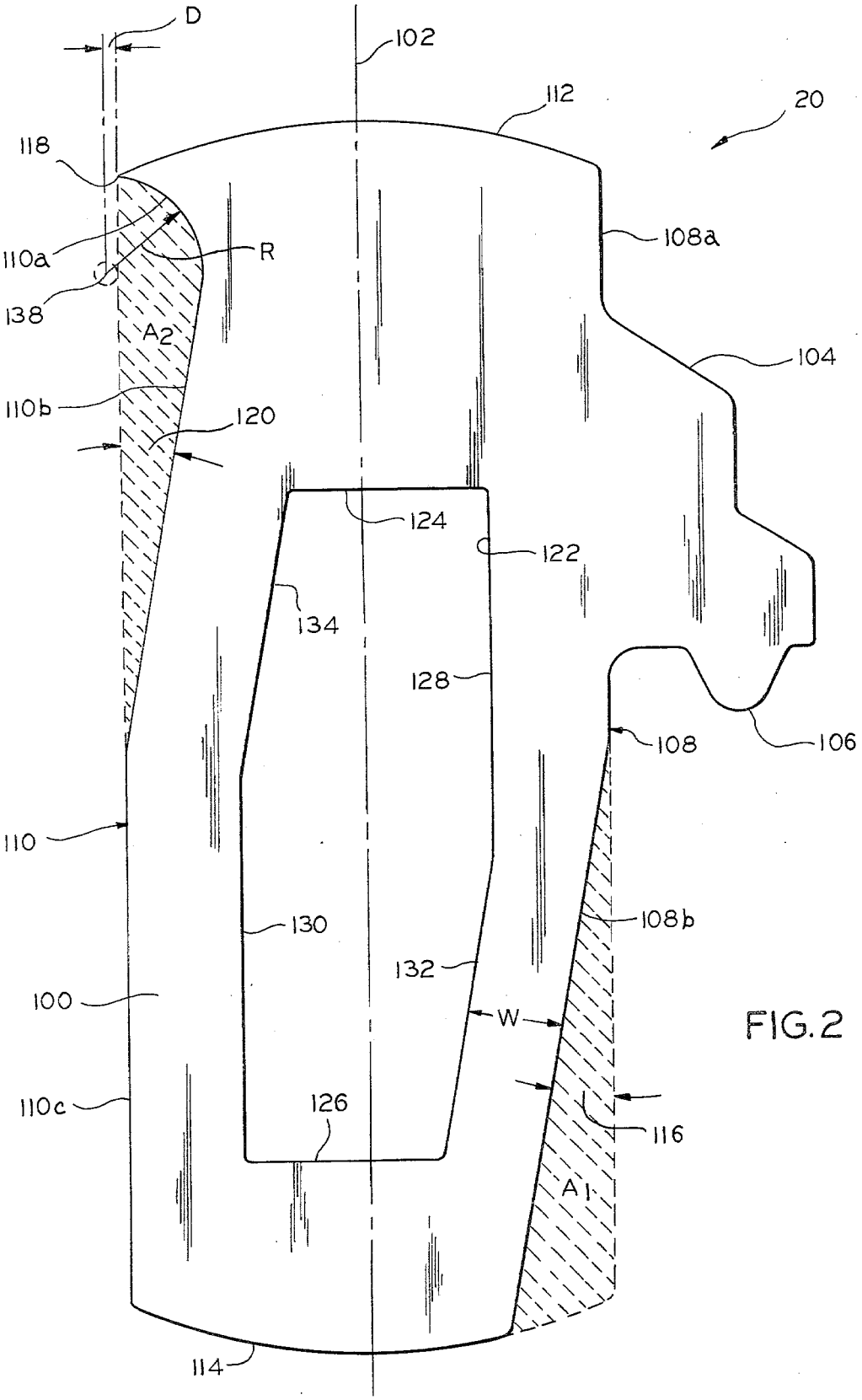
FIG. 2 is a greatly enlarged elevational view of the embodiment of the new plate tumbler illustrated in FIG. 1.

Referring to FIG. 3, each conventional plate tumbler 18 has an elongated body portion 72 bounded by spaced parallel straight first and second side edges 74 and 76, respectively, and convex arcuate first and second end edges 78 and 80, respectively. The end edges 78 and 80 are curved on the arc of a circle having approximately the same radius as the radius of curvature of the plug body 48. A rectangular key-receiving opening 82 is provided in the body portion 72. The opening 82 is bordered at one end by an internal marginal end edge 83 of the body portion 72, which edge serves for engagement with the corresponding key bitting 79. The spacings of the openings 82 in a set of tumblers 18, from the end edges 78 and 80 of the body portion may vary among the tumblers, while matching corresponding bittings on the key 28, in known manner.

The tumbler 18 is completed by a stepped shoulder portion 84 integral with the body portion 72 and projecting outwardly from the second side edge 76, in spaced adjacent relation to the first end edge 78. A protuberance 86 extends longitudinally or depends from the shoulder portion, and it is adapted to be received in an end coil of a tumbler spring 22, for centering purposes.

Referring to FIGS. 2 and 4–6, the new tumbler 20 in accordance with the invention is structurally similar to the conventional tumbler 18, and performs the functions thereof, and, also, has an altered configuration providing additional functions. The changes include the removal or absence of areas $A_1$ and $A_2$ (FIG. 2) at the outer margins of the body portion 72 (FIG. 3) of the conventional tumbler 18, and a change in the configuration of a tumbler opening, necessitated by removal of the marginal areas, as described hereinafter. Thus, the new tumbler 20 includes an elongated plate-like body portion 100 having a longitudinal axis 102, and an integral outwardly projecting stepped shoulder portion 104 having a spring-centering protuberance 106 extending longitudinally or depending therefrom. The body portion 100 is bounded by leading and trailing side edges 108 and 110, respectively, and convex first and second end edges 112 and 114, respectively. The end edges join the leading and trailing edges at a barrel-engaging end and at the opposite end of the body portion. The end edges 112 and 114 of the new tumbler 20 have the same radius of curvature as the corresponding end edges 78 and 80 of the conventional tumbler 18 (FIG. 3), and the length dimensions of the tumblers, measured between their end edges are the same. The shoulder 104 and the protuberance 106 of the new tumbler 20 have the same configurations as the shoulder portion 84 and protuberance 86 of the conventional tumbler 18, and the placements thereof with respect to the end edges of the tumblers are the same.

The leading edge 108 of the new tumbler 20 includes a straight end portion **108*a* at the barrel-engaging end of the tumbler, which is substantially parallel to the axis 102 and is like the corresponding edge portion of the conventional tumbler 18. The leading edge 108 also includes a straight opposite end portion 108*b* at the opposite end of the tumbler, which is inclined with respect to the axis 102. The portion 108*b* extends from about the longitudinal center of the body portion 100 to the opposite end of the tumbler, obliquely inwardly in a direction towards the axis 102 and towards the opposite end. The opposite end portion 108*b* extends at a preferred angle 116 of about 10° to the axis 102 and to the end portion 108*a*, with a preferred tolerance of about ±1°. In comparison to the corresponding area of the conventional tumbler 18, the body portion 100 is relieved thereat to the extent of the area identified by the symbol $A_1$. The shoulder portion 104 projects outwardly from the leading edge 108 between the end portions 108*a* and 108*b*** thereof.

The trailing edge 110 includes an arcuate end portion **110*a* at the barrel-engaging end of the body portion 100, a straight adjacent portion 110*b* which is inclined with respect to the axis 102, and a straight opposite end portion 110*c*. The opposite end portion 110*c* is substantially parallel to the axis 102 and also to the leading edge end portion 108*a*, and is like the corresponding portion of the leading edge 74 of the conventional tumbler 18. The arcuate end portion 110*a* extends outwardly away from the axis 102 and towards the barrel-engaging end of the tumbler, where it intersects the first end edge 112 along a transverse line 118 corresponding to the thickness of the body portion, which line lies substantially in the same plane as the opposite end portion 110*c* of the trailing edge 110. The arcuate end portion 110*a*** is curved on the arc of a circle having the radius R.

The inclined adjacent portion **110*b* of the trailing edge 110 is substantially parallel to the inclined end portion 108*b* of the leading edge 108. The adjacent portion 110*b* extends from the arcuate end portion 110*a* obliquely outwardly in a direction away from the axis 102 and towards the opposite end of the tumbler, to about the longitudinal center of the body portion 100, at a preferred angle 120 of about 10°±1° to the axis 102 and to the end portion 110*c*. In comparison to the corresponding area of the conventional tumbler 18, the body portion 100** is relieved thereat to the extent of the area identified by the symbol $A_2$.

An elongated key-receiving opening 122 is formed in the body portion 100. The opening is bounded by internal marginal edges of the body portion, which include parallel transverse end edges 124 and 126, parallel longitudinal side edge portions 128 and 130, which are parallel to the axis 102, and parallel inclined side edge portions 132 and 134, which are inclined with respect to the axis 102. The longitudinal edge portions 128 and 130 also are parallel to the leading and trailing edge end portions **108*a* and 110*c*, and the inclined edge portions 132 and 134 are parallel to the inclined leading and trailing edge portions 108*b* and 110*b*. The configuration of the opening 122 thus is such as to provide adequate minimum width W of the body portion 100, between the opening 122 and the nearest outer edge of the tumbler body portion, to insure that the tumbler has the requisite structural strength. As in the conventional tumblers 18, the opening 122 assumes other dispositions along the axis 102 in various tumblers 20 in a lock mechanism, which dispositions complement the key bittings 79 and are arranged in accordance with a desired or predetermined key code. The position of the tumbler when the key 28 is inserted is determined by the engagement of the appropriate bitting 79 with the end edge 126**.

Both types of tumblers 18, 20 are mounted in the slots 68 with their shoulder portions 84, 104 projecting through the communicating openings **70*a* and into the adjacent bores 70, where the shoulder portions engage the springs 22 with the protuberances 86, 106 received in the outer spring coils. The tumblers are retained in the plug 16 by peening portions of the plug body 48 in place over the shoulder portions 84, 104. Each of the tumblers 18, 20 is adapted to be received in a slot 68 substantially completely within the plug 16, in a plug-release position thereof. Each tumbler is reciprocally movable in its slot 68 between such release position and a plug-locking position of the tumbler, wherein the barrel-engaging end of the body portion 72 or 100 having the first end edge 78 or 112 projects radially outwardly from the body 48 of the plug. Each tumbler is resiliently mounted by the engaging spring 22, which biases the tumbler into such locking position. The key-receiving opening 82 or 122 of each tumbler registers at least in part with the keyway 64, in the several positions assumed by the tumbler in use. When the key 28 is inserted in the keyway 64, one bitting 79 engages the marginal end edge 83 or 126 bordering each tumbler opening 82 or 122, to move the tumbler out of its locking position and into its release position, where it is held within the plug body 48 against the force of the spring 22**.

In the illustrative lock mechanism 10, the conventional tumblers 18 and the new tumblers 20 are employed in a combination serving to prevent picking of a mechanism which operates in a single direction for unlocking purposes. Two of the new tumblers 20 are mounted in the plug 16, in the first and fifth slots 68 from the head 50 thereof. Conventional tumblers 18 are mounted in the remaining four slots 68. The preference for such selection will be explained and the use of other combinations of tumblers will be described hereinafter.

The mechanism 10 is assembled by inserting the plug assembly 14 into the barrel 12, with the head 50 of the plug received in the head 32 of the barrel, the stop member 56 on the plug seated on the shoulder 44 in the barrel, and the stop lug 46 in the barrel received in the space between the opposite ends of the stop member 56 and adjacent to the rim of the plug head. The lock plate 24 is received on the rear portion 58 of the plug 16 and secured in place by the nut 26 threaded on such portion. The opposite ends of the tumblers 18 and 20 are aligned with the grooves 38 and 40 in the barrel when the plug assembly 14 is in its locking position, and the barrel-engaging end of each tumbler is received in the locking groove 38 adjacent thereto, when the tumblers are in their locking positions.

Figure 4:
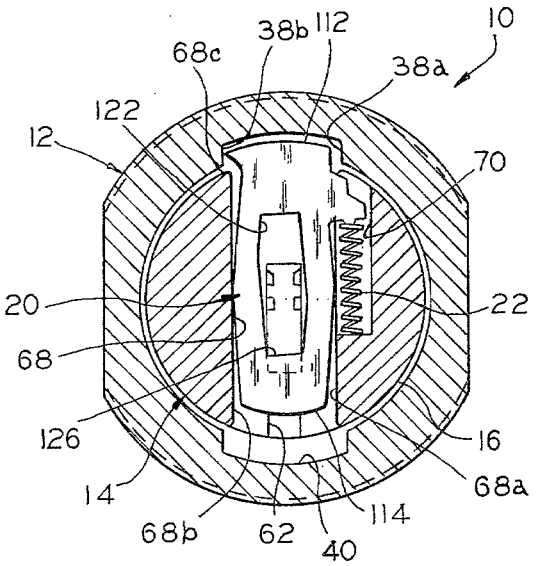
FIGS. 3 and 4 are enlarged cross sectional views of the lock mechanism illustrated in FIG. 1, taken with respect to a key plug assembly thereof substantially on lines 3—3 and 4—4, respectively, of FIG. 1 and illustrating the conventional and new tumblers in the respective views, approximately as they appear in their locking positions, under normal conditions, with the plug assembly in its locking position in a barrel of the lock mechanism.

As illustrated in FIGS. 3 and 4, where the tumblers 18 and 20 are shown in their locking positions, the opening 82, 122 in each tumbler is in partial register with the keyway 64, to permit insertion of a key into the opening. Insertion of the key 28 into the keyway 64 serves to withdraw all of the tumblers from the locking groove 38 and place them in their plug-release positions within the plug 16, whereupon the plug assembly 14 may be rotated relative to the barrel 12 into an unlocking position by turning the key 28, in the clockwise direction in the illustrative embodiment. The lock plate 24 rotates with the plug assembly 14, so that it is in a position to unlock a cabinet or other enclosure when the plug assembly is in its unlocking position. Subsequent rotation of the plug assembly 14 in the counterclockwise direction and withdrawal of the key permits the tumblers under the pressure of the springs 22 to reciprocate to their locking positions. As the key 28 is being inserted or withdrawn, the second end edge 80 or 114 of each tumbler may be moved into the clearance groove 40, owing to engagement of the tumbler with bittings 79 other than the bitting which holds the tumbler completely within the plug, in known manner. The rotation of the plug assembly 14 in opposite directions is limited by engagement of the stop lug 46 on the barrel with the stop member 56 on the plug.

Referring to FIG. 3, the conventional tumbler 18 is received in its slot 68 with its leading edge 74 and trailing edge 76 generally parallel to the transverse side walls 68*a* and 68*b* of the slot and adjacent to the walls for engagement therewith in performing the locking functions of the tumbler. Typical dimensions for a lock mechanism having a diameter for the barrel body 30 of $\frac{3}{4}$ inch and a diameter for the plug body 48 of 0.49 inch include 0.188 to 0.192-inch width for the body portion 72 of the tumbler 18, exclusive of the shoulder portion 84, 0.194 to 0.200-inch width for the tumbler-receiving slots 68, and 0.218 to 0.220-inch width for the tumbler-receiving grooves 38 and 40. The corresponding length of the tumbler 18 is 0.484 inch, and the minimum width W between the opening 122 and any external edge is 0.035 inch. The resulting tolerances permit certain amounts of relative movement between the parts which, however, are minimized to minimize the susceptibility to picking. It will be understood that with the spring 22 supporting the shoulder portion 84 on one side of the tumbler 18, the tumbler actually will be slightly tilted with respect to the transverse walls 68*a* and 68*b* of the tumbler slot 68.

When an attempt is made to pick the lock mechanism 10, a torque is applied to the plug assembly 14, particularly the plug 16, which tends to rotate the assembly relative to the barrel 12 in a clockwise direction to its unlocking position. The applied torque causes the upper (as illustrated) end portion of the leading edge 74 of the conventional tumbler 18 to engage the adjacent side wall 38*a* of the longitudinal groove 38 in the barrel. The plug assembly 14 is prevented from rotating further, so long as the tumbler is in its locking position. While the torque is applied, a picking tool such as a wire is inserted through the keyway 64, and force is applied to the lower end edge 83 bounding the opening 82, so as to move the tumbler to its release position within the plug, whereupon the first end edge 78 of the tumbler may be caught inside of the barrel bore 37 where it joins the groove wall 38*a*. If all tumblers can be caught and held in this position at one time, the plug assembly 14 can be rotated further, to its unlocking position.

Figure 5:
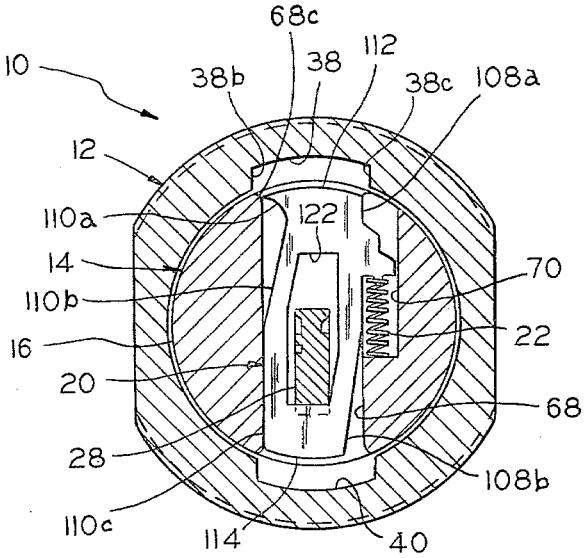
FIG. 5 is a view like FIG. 4, but with the key inserted in the plug assembly so as to place the tumbler in its plug-release position.

The present invention prevents for forestalls picking in the foregoing manner, by virtue of the construction of the new tumbler 20, and its cooperation and combination with other parts, while conforming the new structure to the conventional structure in certain respects, thereby to minimize tolerances which can increase the susceptibility to picking. Thus, as described hereinabove, the new tumbler 20 preferably has the same length and width dimensions as the conventional tumbler 18, except for the omission of the areas $A_1$ and $A_2$ from the former. When the new tumbler 20 is in its release position entirely within the plug 16, as illustrated in FIG. 5, it assumes substantially the same position as assumed by the conventional tumbler 18 in the release position. The locking position of the new tumbler 20, illustrated in FIG. 4 is similar to that of the conventional tumbler 18, illustrated in FIG. 3, except that the new tumbler 20 is tilted to a greater extent, owing to the relief areas. When a picking attempt is made, the new tumbler 20 is rocked into the position illustrated in FIG. 6, wherein it engages the plug 16 to prevent the tumbler from being moved into its release position.

Figure 6:
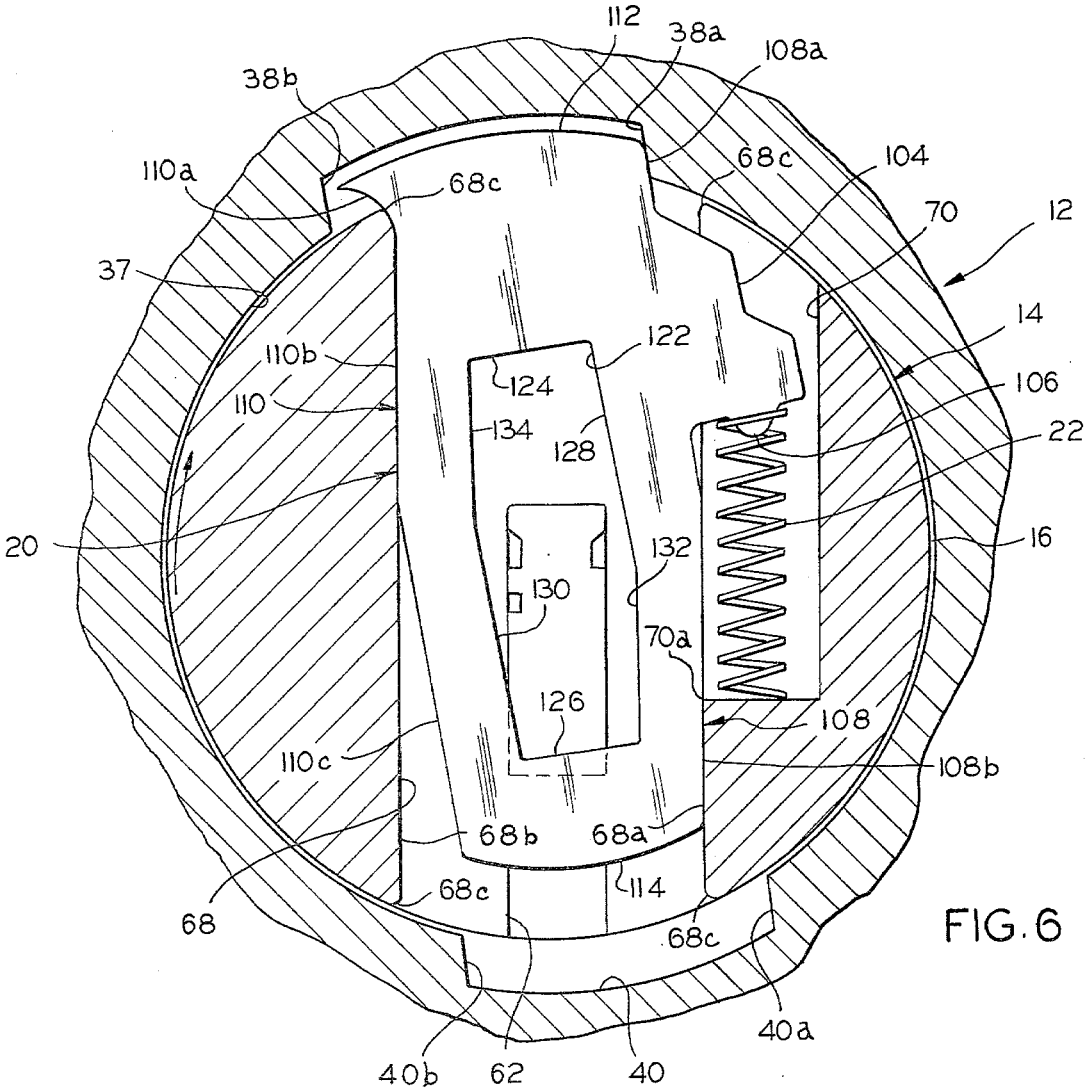
FIG. 6 is a view similar to FIG. 4, on an enlarged scale with respect thereto, but illustrating the lock mechanism as it appears when the plug assembly is subjected to torque relative to the barrel, which causes the new plate tumbler to be locked to the plug of the assembly.

Thus, when torque is applied to the plug 16 in the direction of the arrow in FIG. 6, while the barrel-engaging end of the tumbler 20, having the edge 112, projects into the longitudinal locking groove 38, the corresponding end portion 108*a* of the leading edge 108 abuttingly engages the adjacent longitudinal side wall 38*a*. Such engagement causes the arcuate portion 110*a* of the trailing edge 110 to engage the adjacent slightly rounded edge 68*c* of the slot side wall 68*b*, whereby the tumbler is rocked in a counterclockwise direction. Thereupon, the inclined end portion 108*b* of the leading edge 108 engages the adjacent transverse side wall 68*a*, and the inclined portion 110*b* of the trailing edge 110 engages the adjacent transverse side wall 68*b*. When a downward (as illustrated) force is applied to the key-engaging marginal end edge 126 on the lower side of the tumbler opening 122, which force tends to move the tumbler 20 to its release position, the arcuate portion 110*a* of the trailing edge projects laterally outwardly over the plug 16 from the transverse side wall 68*b* adjacent thereto, in engagement with the plug. The arcuate portion 110*a* is so contoured and arranged that the force on the tumbler acts predominantly on the outer surface or the top of the plug as shown, and in the direction in which the transverse side wall 68*b* extends, or downwardly as shown, so as to avoid camming action at the rounded edge 68*c*. The tumbler 20 is tightly locked in place by virtue of the aforesaid engagement of its several edge portions, preventing it from being moved into its release position, thereby to prevent rotation of the plug assembly 14 to its unlocking position.

The above-described angles 116 and 120 for the inclined edge portions 108*b* and 110*b* of the tumbler 20 are illustrative of inclinations which produce the desired results. For cooperation therewith, it is preferred that the radius R of the arcuate edge portion 110*a* in the illustrative embodiment be about 0.039 inch, and that the center 138 of the circle of which the arc forms a part be spaced laterally outwardly of the plane of the trailing edge end portion 110*c* for a distance D of 0.005 inch. The adjacent inclined trailing edge portion 110*b* is approximately tangent to the arcuate edge portion 110*a*.

The arcuate edge portion 110*a* forms a hook or claw-like part of the body portion 100 which, in addition to engaging the plug 16 in the manner and with the results described above, has the strength necessary to avoid breaking off the part in manufacture or in use, in the latter case either as a result of key operation or as a result of forcing the tumbler in the lock mechanism. Also, the hook-like part resists damage due to plug torque exerted in the opposite direction. The preferred angles 116 and 120 are selected to permit the desired amount of rocking movement while avoiding too much play, such as may decrease pick resistance or create an alignment problem in connection with the insertion of the key.

The retention of the parallel, axially-directed leading and trailing end edge portions 108*a* and 110*c*, as provided in the conventional tumbler 18, serves to preserve an effective sliding action of the tumbler 20 into the tumbler slot 68 upon insertion of the key 28, with less chance of misalignment and inadvertent hooking of the arcuate portion 110*a* on the outer surface of the plug.

The tumblers 18 are punched from sheet metal in a conventional manner. The new tumblers 20 also are punched from sheet metal, and a progressive dye is employed in a punch press, to perform a three-step operation. In the first step, a circular hole is punched out. In the illustrative embodiment, the hole has the above-described radius R of 0.039 of the arcuate edge portion 110*a*. In the second operation, the key-receiving opening 122 is punched in the sheet material. In the third operation, the complete tumbler 20 is punched out, being formed around a portion of the periphery of the initial, circular hole, to thereby provide the arcuate edge portion 110*a*, and encompassing the key-receiving opening 122. The sequence of operations is preferred especially for providing the arcuate edge portion 110*a* extending adjacent to and intersecting the first end edge 112, and providing the adjacent edge portion 110*b* of the trailing edge 110 with minimal manufacturing damage or wastage.

It is preferred to employ two or more of the new tumblers 20 for preventing rotation of the key plug assembly 14 in a given direction in a picking attempt, to minimize any adverse effect of the tolerance resulting from the relief corresponding to the areas $A_1$ and $A_2$. At the same time, it is preferred to employ one or more conventional tumblers 18 in the plug assembly to minimize unintended hooking of the arcuate edge portion 110*a* on the plug 16.

With both conventional and new tumblers 18 and 20 provided in the key plug assembly 14, a two-stage effect is created when it is attempted to pick the lock mechanism, itself confusing to a would-be picker. Thus, when clockwise torque is applied to the plug assembly 14, the conventional tumblers 18 are frictionally held in firm engagement with the wall 38*a* of the barrel groove 38. The new tumblers 20 have more freedom of movement owing to the relief areas provided, and are not held in such firm engagement, if they are engaged at all. consequently, the conventional tumblers 18 may be caught within the barrel bore 37, while the tumblers 20 are very difficult to catch in that manner. When all of the conventional tumblers 18 are caught, the plug assembly 14 rotates further in the clockwise direction, owing to the torque applied thereto, causing the new tumblers 20 to be rocked into the position illustrated in FIG. 6, wherein their engagement with the plug 16 prevents them from being picked.

While the illustrative embodiment provides resistance to an attempt to pick the lock mechanism for rotation in one direction to an unlocking position of the plug assembly, like resistance to picking for rotation of the plug assembly in the opposite direction may be provided by employing a new tumbler 20 disposed in one of the slots 68 with its leading and trailing side edges 108 and 110 transposed with respect to the disposition illustrated in FIGS. 4–6, and placing the tumbler in a slot 68 having a spring-receiving bore 70 on the opposite side of the slot, as illustrated by the slot 68 and bore 70 of FIG. 3. In this manner, a "two-way turn" lock mechanism may be protected against rotation of the plug assembly thereof to an unlocking position in either direction. It will be apparent that operation will be as described above with reference to FIGS. 4–6, except for the transposition of parts and the resulting interengagement of different surfaces when the new tumbler is in pick-resistant engagement with the plug 16.

The invention may be employed in cylinder lock mechanisms for various types of locks, such as drawer, cabinet, switchbox, handle, zipper bag and briefcase locks. The illustrative lock mechanism is especially suited for use in a cabinet lock or the like. In other applications, the plug and the barrel are appropriately constructed for mounting in the particular environment and making the desired connections, in conventional ways.

While preferred embodiments of the invention have been described and illustrated, it will be apparent to those skilled in the art that various changes and modifications may be made therein within the spirit and scope of the invention. It is intended that all such changes and modifications be included within the scope of the appended claims.

I claim:

1. An improved plate tumbler for a cylinder lock mechanism, said lock mechanism including: a tubular barrel provided with an internal longitudinal tumbler-receiving groove bounded by a tumbler-engaging longitudinal side wall, and a key plug assembly mounted in said barrel for rotation relative thereto from a locking position to an unlocking position, said plug assembly including a key plug, a plurality of plate tumblers disposed in said plug in a longitudinal series, and spring means resiliently mounting said tumblers in said plug, said plug being provided with a longitudinal keyway and with a plurality of transverse tumbler-receiving slots intersecting said keyway and arranged for registry with said groove in said locking position of the plug assembly, each of said slots being bounded by a pair of opposed tumbler-engaging transverse side walls, each of said tumblers being received in a tumbler-receiving slot substantially completely within said plug in a plug-release position of the tumbler and being reciprocally movable in the slot between such release position and a plug-locking position of the tumbler wherein a barrel-engaging end thereof projects from the plug for reception in said groove when in registry with the slot, said tumblers being biased by said spring means towards their locking positions, and said tumblers engaging a bitted key inserted in said keyway thereby to move the tumblers out of their locking positions and into their release positions and enable the plug assembly to be rotated to its unlocking position; said improved tumbler being receivable in a tumbler-receiving slot for movement between such release and locking positions while biased towards its locking position by said spring means, and for such engagement with a key, and comprising:

a plate-like body portion having a leading edge and a trailing edge on opposite sides of a longitudinal axis of the body portion, said body portion being received in one of said slots with said axis extending transversely of the plug and said edges disposed adjacent to respective ones of the transverse side walls bounding the slot for engagement therewith when the tumbler is disposed in the slot, one end portion of said leading edge at a barrel-engaging end of the tumbler projecting from said plug into said groove in the barrel for engagement with said longitudinal side wall to prevent relative rotation of said plug assembly towards its unlocking position when the plug assembly is in its locking position with the tumbler disposed in its locking position in said one slot, the opposite end portion of said leading edge at the opposite end of the tumbler extending obliquely inwardly in a direction towards said axis and towards said opposite end of the tumbler, one end portion of said trailing edge at said barrel-engaging end of the tumbler projecting from said plug into said groove when the plug assembly is in its locking position with the tumbler disposed in its locking position in said one slot, said one end portion of the trailing edge extending arcuately outwardly away from said axis and towards said barrel-engaging end of the tumbler, and a portion of said trailing edge adjacent to said one end portion thereof extending from the latter portion obliquely outwardly in a direction away from said axis and towards said opposite end of the tumbler, whereby, when the plug assembly is in its locking position with the tumbler in its locking position in said one slot, and torque is applied to the plug assembly tending to rotate it to its unlocking position while a force is applied to the tumbler tending to move the tumbler to its release position in a picking operation, said one end portion of the leading edge engages said longitudinal side wall, and said opposite end portion of the leading edge engages the adjacent transverse side wall, while said one end portion of the trailing edge projects laterally outwardly over the plug from the transverse side wall which is adjacent to such end portion, in engagement with the plug to prevent the tumbler from being moved into its release position, thereby to prevent rotation of the plug assembly to its unlocking position.

2. A tumbler as defined in claim 1 and wherein said one end portion of said leading edge and a further portion of said trailing edge adjacent to said opposite end of the tumbler are substantially parallel to said axis, and said opposite end portion of said leading edge and said adjacent portion of said trailing edge extend at angles of about 10 degrees to said axis.

3. A tumbler as defined in claim 2 and wherein said body portion has an end edge joining said leading and trailing edges at said barrel-engaging end of the tumbler, said one end portion of the trailing edge intersects said end edge along a line lying approximately in the plane of said further portion of the trailing edge, and said one end portion of the trailing edge is curved on the arc of a circle approximately tangent to said adjacent portion of the trailing edge.

4. A tumbler as defined in claim 1, 2, or 3 for a cylinder lock mechanism in which said transverse side walls are substantially parallel, a blind bore is provided in said plug adjacent to and in communication with each of said slots along one side edge thereof, and said spring means comprises a tumbler spring disposed in each bore, and wherein the tumbler also includes a shoulder portion projecting outwardly from said leading edge of said body portion between said one end portion and said opposite end portion thereof, said shoulder portion being adapted to extend into the bore adjacent to said one slot in which the tumbler is disposed and to engage the tumbler spring therein for biasing the tumbler towards its said locking position.

5. In a cylinder lock mechanism which includes a tubular barrel provided with an internal longitudinal tumbler-receiving groove bounded by a tumbler-engaging longitudinal side wall, and a key plug assembly mounted in said barrel for rotation relative thereto from a locking position to an unlocking position, said plug assembly including a key plug, a plurality of plate tumblers disposed in said plug in a longitudinal series, and spring means resiliently mounting said tumblers in said plug, said plug being provided with a longitudinal keyway and with a plurality of transverse tumbler-receiving slots intersecting said keyway and arranged for registry with said groove in said locking position of the plug assembly, each of said slots being bounded by a pair of opposed tumbler-engaging transverse side walls, each of said tumblers being received in a tumbler-receiving slot substantially completely within said plug in a plug-release position of the tumbler and being reciprocally movable in the slot between such release position and a plug-locking position of the tumbler wherein a barrel-engaging end thereof projects from the plug for reception in said groove when in registry with the slot, said tumblers being biased by said spring means towards their locking positions, and said tumblers engaging a bitted key inserted in said keyway thereby to move the tumblers out of their locking positions and into their release positions and enable the plug assembly to be rotated to its unlocking position, an improved tumbler receiving in one of said slots for movement between such release and locking positions and biased towards its locking position by said spring means, and adapted for such engagement with a key, said improved tumbler comprising:

a plate-like body portion havng a leading edge and a trailing edge on opposite sides of a longitudinal axis of the body portion, said body portion being received in said one slot with said axis extending transversely of said plug and said edges disposed adjacent to respective ones of the transverse side walls bounding the slot for engagement therewith.

one end portion of said leading edge at a barrel-engaging end of the tumbler projecting from said plug into said groove in the barrel for engagement with said longitudinal side wall to prevent relative rotation of said plug assembly towards its unlocking position when the plug assembly is in its locking position with the tumbler disposed in its locking position, the opposite end portion of said leading edge at the opposite end of the tumbler extending obliquely inwardly in a direction towards said axis and towards said opposite end of the tumbler, one end portion of said trailing edge at said barrel-engaging end of the tumbler projecting from said plug into said groove when the plug assembly is in its locking position with the tumbler disposed in its locking position, said one end portion of the trailing edge extending arcuately outwardly away from said axis and towards said barrel-engaging end of the tumbler, and a portion of said trailing edge adjacent to said one end portion thereof extending from the latter portion obliquely outwardly in a direction away from said axis and towards said opposite end of the tumbler, whereby when the plug assembly is in its locking position with the tumbler in its locking position, and torque is applied to the plug assembly tending to rotate it to its unlocking position while a force is applied to the tumbler tending to move the tumbler to its release position in a picking operation, said one end portion of the leading edge engages said longitudinal side wall, and said opposite end portion of the leading edge engages the adjacent transverse side wall, while said one end portion of the trailing edge projects laterally outwardly over the plug from the transverse side wall which is adjacent to such end portion, in engagement with the plug to prevent the tumbler from being moved into its release position, thereby to prevent rotation of the plug assembly to its unlocking position.

6. A lock mechanism as defined in claim 5 and wherein said one end portion of said leading edge and a further portion of said trailing edge adjacent to said opposite end of the tumbler are substantially parallel to said axis, and said opposite end portion of said leading edge and said adjacent portion of said trailing edge extend at angles of about 10 degrees to said axis.

7. A lock mechanism as defined in claim 6 and wherein said body portion has an end edge joining said leading and trailing edges at said barrel-engaging end of the tumbler, said one end portion of the trailing edge intersects said end along a line lying approximately in the plane of said further portion of the trailing edge, and said one end portion of the trailing edge is curved on the arc of a circle approximately tangent to said adjacent portion of the trailing edge.

8. A lock mechanism as defined in claim 5, 6, or 7 and wherein said transverse side walls are substantially parallel, a blind bore is provided in said plug adjacent to and in communication with each of said slots along one side edge thereof, said spring means comprises a tumbler spring disposed in each bore, and said improved tumbler also includes a shoulder portion projecting outwardly from said leading edge of said body portion between said one end portion and said opposite end portion thereof, said shoulder portion extending into the bore adjacent to the slot in which the tumbler is disposed and engaging the tumbler spring therein for biasing the tumbler towards its said locking position.

9. A lock mechanism as defined in claim 8 and wherein said groove is bounded by a pair of said tumbler-engaging longitudinal side walls in opposed substantially parallel relation, said bores and slots in communication therwith are provided in two groups having their respective bores disposed on opposite sides of said keyway, and an improved tumbler is disposed in a slot of each group, thereby to prevent rotation of the plug assembly to an unlocking position thereof in either direction.

* * * * *